United States Patent [19]

Fraas

[11] 4,072,183

[45] Feb. 7, 1978

[54] HEAT EXCHANGER WITH INTERMEDIATE EVAPORATING AND CONDENSING FLUID

[75] Inventor: Arthur P. Fraas, Knoxville, Tenn.

[73] Assignee: The United States of America as represented by the United States Department of Energy, Washington, D.C.

[21] Appl. No.: 745,941

[22] Filed: Nov. 29, 1976

[51] Int. Cl.[2] ..... F28D 15/00

[52] U.S. Cl. ..... 165/11; 122/33; 165/13; 165/70; 165/105; 165/134

[58] Field of Search ..... 165/11, 13, 70, 105, 165/134; 122/33

[56] References Cited

U.S. PATENT DOCUMENTS

| | | | |
|---|---|---|---|
| 1,123,392 | 1/1915 | Fraas | 165/105 |
| 2,119,091 | 5/1938 | Atkinson et al. | 165/105 X |
| 3,583,479 | 6/1971 | Taylor et al. | 165/134 |
| 3,633,665 | 1/1972 | France et al. | 165/105 |

*Primary Examiner*—Albert W. Davis, Jr.

*Attorney, Agent, or Firm*—Dean E. Carlson; Stephen D. Hamel; Allen H. Uzzell

[57] ABSTRACT

A shell and tube-type heat exchanger, such as a liquid sodium-operated steam generator for use in nuclear reactors, comprises a shell containing a primary fluid tube bundle, a secondary fluid tube bundle at higher elevation, and an intermediate fluid vaporizing at the surface of the primary fluid tubes and condensing at the surface of the secondary fluid tubes.

10 Claims, 4 Drawing Figures

HEAT EXCHANGER WITH INTERMEDIATE EVAPORATING AND CONDENSING FLUID

BACKGROUND OF THE INVENTION

This invention was made during the course of, or under, a contract with the U.S. Energy Research and Development Administration.

It relates in general to heat exchangers and, more specifically, to the type of heat exchanger, such as a fluid-operated steam generator, in which heat is transferred from a primary fluid to a vaporizing secondary fluid. The heat exchanger described herein is particularly suited for those applications where the primary fluid such as liquid sodium is used to heat a secondary fluid with which it is highly reactive, such as water. Though the bulk of the specification will be directed to a liquid sodium-heated steam generator, it will be apparent that this heat exchanger or equivalents thereof are useful with other fluids.

Prior Art

The advantages of liquid metal as a coolant for nuclear reactors have led to the preparation of a variety of designs for liquid sodium-heated steam generators that have been presented in the prior art. For the most part, the prior art designs comprised a plurality of tubes for carrying water which were immersed or otherwise in direct contact with liquid sodium. Several configurations have been described which would prevent or limit the consequences of the violent chemical reaction which results in the event of a failure in the structures separating the sodium and the water circuits. For example, U.S. Pat. No. 3,613,780 discloses the use of collapsible diaphrams within the housing to absorb most of the energy of violent reaction. U.S. Pat. No. 3,651,789 describes a design which reverses the flow of liquid sodium entering the exchanger in order to reduce the impingement of liquid sodium on water-carrying tubes. U.S. Pat. No. 3,741,167 and 3,812,824 disclose a heat exchanger having a wide central passageway and exhaust for rapidly removing reaction products (i.e., hydrogen) in the event of failure. U.S. Pat. No. 3,888,212 proposes a centrifugal separator to facilitate flow of liquid metal away from a central cavity for exhaust gases. U.S. Pat. No.3,726,339 discloses a heat exchanger in which the weldments are protected by a corrosion-resistant alloy to limit damage from a sodium/water reaction. In the design described in U.S. Pat. No. 3,868,994 liquid sodium flows in double-walled tubes in direct heat exchange relationship with water flowing on the outside of the tubes. U.S. Pat. No. 3,892,205 suggests a reservior of liquid metal which is unreactive with sodium and water, e.g., mercury, surrounding the tube-to-tube sheet weldments most likely to be the site of leaks. In each of these prior art heat exchangers, the sodium circuit is to some extent in direct heat exchange relationship with the water circuit, thus any leaks in the separating structures would inevitably be accompanied by the violent sodium/water reaction. In many prior art designs, tube leaks would be accompanied by permanent damage to the surrounding structure, requiring extensive refabrication and repair.

SUMMARY OF THE INVENTION

It is an object of this invention to provide a shell-and-tube type heat exchanger which substantially reduces the hazards of reaction between the primary and secondary fluids.

It is a further object to provide a heat exchanger of high efficiency in which the primary and secondary fluids are in indirect heat exchange relationship.

It is a further object to provide a liquid metal operated steam generator which is easy to disassemble and maintain in the event of tube failure.

These and other objects are provided according to this invention in a heat exchanger comprising:

a. a shell defining an interior cavity;

b. a first tube bundle disposed within said interior cavity for carrying high temperature primary fluid;

c. a second tube bundle disposed within said interior cavity generally parallel to and at a higher elevation than said first tube bundle, for carrying low temperature secondary fluid;

d. an intermediate fluid having a boiling point between the temperatures of tubes in said first tube bundle and tubes in said second tube bundle and disposed within said interior cavity such that during operation of said heat exchanger said intermediate fluid vaporizes at the surfaces of tubes in said first tube bundle and condenses at surfaces of tubes in said second tube bundle;

e. a liquid-conducting baffle disposed within said interior cavity in a region between said first and second tube bundles and extending in a direction parallel to said bundles for preventing the direct impingement of secondary fluid onto said first tube bundle in the event of a leak in said second tube bundle, said baffle being adapted for conducting condensed intermediate fluid from said second bundle to said first bundle.

In a preferred embodiment, one or more transverse baffles disposed within the housing and extending in a direction perpendicular to the tube bundles and substantially to the periphery of the interior cavity are provided. These baffles operate to segment the interior cavity and reduce the effects of axial temperature differences along the length of the cavity. When the intermediate fluid comprises more than one component of different boiling points, the transverse baffles function in the manner of stages in a fractionating tower to allow the components to distribute among the segments according to their boiling points, thereby providing a range of temperature zones, thus maximizing heat transfer efficiency.

When used as a steam generator with an intermediate fluid comprising an alkali metal, even trace leaks in the heat exchanger steam circuit are quickly detectable by a hydrogen detector which provides a signal for responsive electronic circuitry which controls the water input and a dump valve for rapid evacuation of the intermediate fluid.

DETAILED DESCRIPTION

Figure 1:
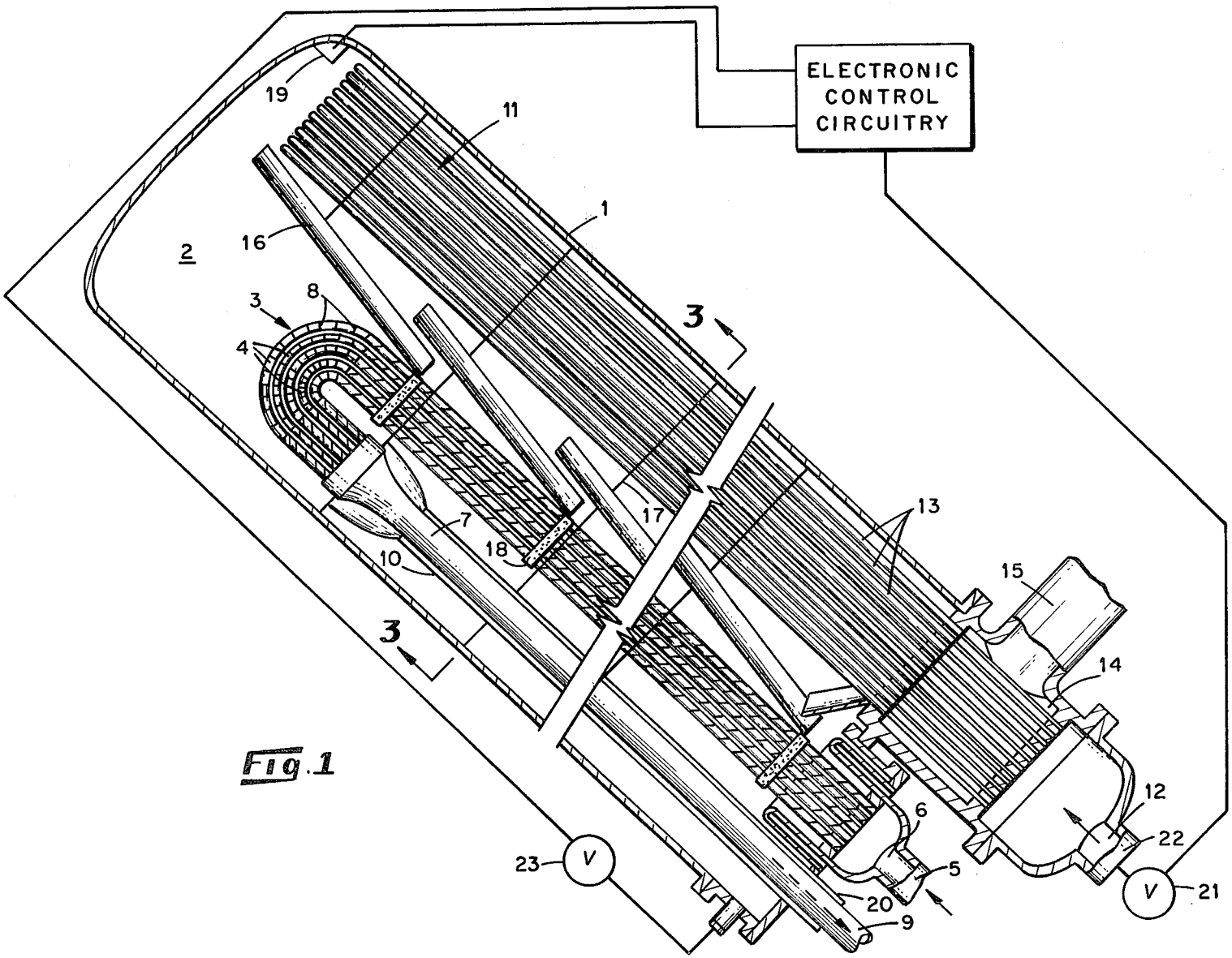
FIG. 1 is a schematic cross-section of a heat exchanger in accordance with this invention.

This invention is a tube-and-shell type heat exchanger through which primary and secondary fluids are conducted in closed tubes extending into the interior cavity of the shell. The primary fluid, typically liquid sodium, is at a high temperature and flows through a first tube bundle. The secondary fluid, typically water, is at a low temperature (relative to the primary fluid) and flows through a second tube bundle generally parallel to and at a higher elevation than the first tube bundle. By higher elevation it is meant that, when the heat exchanger is in the operating orientation, fluid vaporizing at the surfaces of tubes in the first bundle rises to condense at the surfaces of tubes in the second bundle and then falls or flows under the force of gravity back to the first bundle; that is, there are positions on the second tube bundle at a higher vertical position than the complementary positions on the first tube bundle. As will be apparent from this specification, it is not necessary that the primary and secondary tube bundles be strictly parallel, only generally parallel (i.e., extending in parallel directions). Within the interior cavity of the shell is an intermediate fluid having a boiling point intermediate between the temperatures of the primary and secondary tube bundles. During operation of the heat exchanger, the intermediate fluid vaporizes at the surface of tubes carrying primary fluid and condenses at the surface of tubes carrying secondary fluid. In this manner heat is efficiently conducted from the primary fluid circuit to the secondary fluid circuit, largely as the latent heat of vaporization of the intermediate fluid. Of course, the boiling point of the intermediate fluid will be dependent upon pressures prevailing within the shell cavity. All that is necessary for the operation of the heat exchanger is that the intermediate fluid have a boiling point at the operating pressures which is intermediate between the high temperature of the primary fluid tubes and the low temperature of the secondary fluid tubes. Of course, the "high" and "low" temperatures refer only to relative values and are used herein for the sake of clarity. One or more liquid conducting baffles are disposed in a region between the first and second tube bundles and extending in a direction generally parallel to the bundles for preventing the direct impingement of secondary fluid onto the first tube bundle in the event of a leak in the second bundle which would generally be at higher pressure. The baffles are adapted to conduct condensed fluid from the second tube bundle to the first tube bundle, e.g., by providing a gravity flow path. The baffles need not extend to the periphery of the interior housing, but are preferably spaced apart from the housing interior surface to provide a pathway for intermediate fluid vapor to flow to the second tube bundle. It is not necessary that these baffles be parallel to the tube bundles, but only that they extend in a direction parallel to the tube bundles to prevent impingement. Actually, only one baffle extending the entire length of the first tube bundle would effectively prevent impingement. Conduits could then be supplied in the single baffle for directing condensed intermediate fluid to the primary fluid tubes. Alternatively, a plurality of overlapping inclined baffles is effective for preventing impingement and for conducting condensate to the lower first tube bundle. It will be apparent that many configurations of baffles would be effective for providing gravity flow between the tube bundles and preventing direct impingement of leaking fluid in accordance with my invention.

To enhance the heat transfer characteristics of the tubes, they could be fluted or finned or otherwise of irregular surface to take advantage of capillary forces to improve the flow distribution of the liquid film. In a preferred embodiment of this invention, the tubes in the first tube bundle should have a convoluted surface to facilitate distribution of the liquid intermediate fluid over the hot surface from which it evaporates. In addition, or alternatively, the first tube bundles could be provided with wicks surrounding the tubes at several positions for distributing the liquid intermediate fluid over the tube surfaces.

In a preferred embodiment, at least one transverse baffle extending in a directing perpendicular to the tube bundle axes is provided for dividing the interior cavity into separate region segments differing in temperature. This difference in temperature is due to the axial temperature variation of the primary fluid and causes the vapor pressure of a single component intermediate fluid to vary between the segments or regions. When a multicomponent intermediate fluid is employed, the pressure differentials between the segments are minimized by a variance in the composition of the intermediate fluid between the segments. In either case, the heat transfer efficiency in each region, manifested by a small temperature difference between primary fluid tubes and secondary fluid tubes, is enhanced. When the interior cavity is segmented in this manner, the operating pressure and temperature of the intermediate fluid will inherently accommodate to the axial temperature gradient in the primary fluid, thus the effects of temperature differential over the length of the primary fluid circuit are minimized from both the heat transfer and thermal stress standpoints. More specifically, the pressure of the several regions will be such that boiling of the intermediate fluid will occur at the temperature of the primary fluid tube surfaces. For example, as the primary fluid passes through the first tube bundle, it may experience a temperature drop of perhpas 160° F. In the temperature range of interest for sodium-cooled reactors, for example, the vapor pressure of cesium changes from 0.5 psia to 2.0 psia with a change in the boiling point of about 160° F. Thus, the intermediate fluid region at the hotter end of the heat exchanger would operate at a cesium vapor pressure 1.5 psia (i.e., a head of two feet of liquid cesium) higher than the lower temperature region at the other end. The liquid condensate passages coupling adjacent regions to ensure the proper axial distribution of liquid would be designed to provide sufficient difference in elevation between the inlet and outlet of each segment to give at least the required head of liquid to permit interregional flow. As is customary in the design of heat pipes, etc., the proportions of vapor and liquid flow passage area can be made such to give good performance characteristics over the entire load range from zero to full power.

From the thermal stress standpoint, as a general rule of equipment design, a local temperature differential (such as radially through a tube wall) of no more than 100° F should be allowed in a stainless steel structual element. By segmenting the heat exchanger into segments having no more than 100° F differential within each segment, the thermal stress can be reduced. Accordingly, it is preferred that for every axial temperature drop of 100° F in the primary fluid tubes, there would be at least one transverse baffle. Additional transverse baffles would provide additional thermal stress reduction if needed. The advantage of segmenting the interior cavity to provide an axial temperature gradient can also be obtained by employing a multi-component mixture as the intermediate fluid. If this is done, the intermediate fluid region can be at a uniform pressure so that the transverse baffles need not fit closely to the periphery of the cavity or to the parallel baffles to reduce the vapor flow from one region to another to a modest level. Rather, the natural distribution in the compositon of the multi-component fluid among the segments will serve to minimize the pressure differential between the hotter and colder regions of the heat exchanger, and permit more efficient heat transfer at the various temperatures. Under these conditions, the heat exchanger would resemble a fractionating tower with the lower boiling point component more concentrated in the cooler segments. For a typical sodium-heated steam generator, for example having an intermediate fluid consisting of a mixture of cesium and potassium in a 1:1 mole ratio, the intermediate fluid in the first (or hot) region might be potassium boiling at 1.0 psia and 1000° F with the temperature of the sodium dropping from 1100° to 1030° F. In the second region, a mixture of potassium and cesium boiling at 1.0 psia, and 940° F would remove heat from the sodium whose temperature would drop from 1030° to 970° F. In the last region, the intermediate fluid would be mainly cesium boiling at 1.0 psia and 860° F, while the sodium temperature would drop from 970° F to 900° F. In this manner, though the segments would vary in temperature, the pressures would be about the same owing to the different component concentrations. With the pressure maintained substantially constant throughout the length of the shell, the vapor flow passage areas required for good heat transfer efficiency at the higher temperature regions near the primary fluid inlet can be essentially the same as the vapor flow passages in the lower temperature regions. As in the above illustration, in the temperature range currently of interest for sodium-cooled reactors, cesium has a boiling point lower than that of potassium by 140° to 160° F depending on the pressure. The axial segmentation of a heat exchanger would give a high concentration of cesium in the intermediate fluid region at the cold end and a high concentration of potassium in a 140° to 160° F hotter region at the same pressure, and the vapor flow passage area requirements through the tube bundle would be essentially the same. The precise dimensions of the respective tubes are a function of the expected operating conditions and fluids and can be readily determined by those familiar with the principles of equipment design. The use of a multi-component intermediate fluid would also ease or avoid the detail design problems associated with accommodation of difference in static liquid head between adjacent regions. For example, when designing for use with a multi-component intermediate fluid, the clearance between the shell and the transverse baffles can be quite generous, whereas expensively close tolerances would be required for a single component fluid if the pressure differentials between regions were substantial.

When the heat exchanger of this invention is used with a high temperature primary fluid such as liquid sodium, the intermediate fluid should be an alkali metal such as sodium, potassium, rubidium, cesium, lithium or mixtures thereof. Alkali metals are preferred because of their good compatibility with structural materials and their exceptionally high heat transfer coefficients. With other primary fluids such as molten salts or other hot liquids, organic materials can also be used as intermediate fluids.

PREFERRED EMBODIMENT

Figure 2:
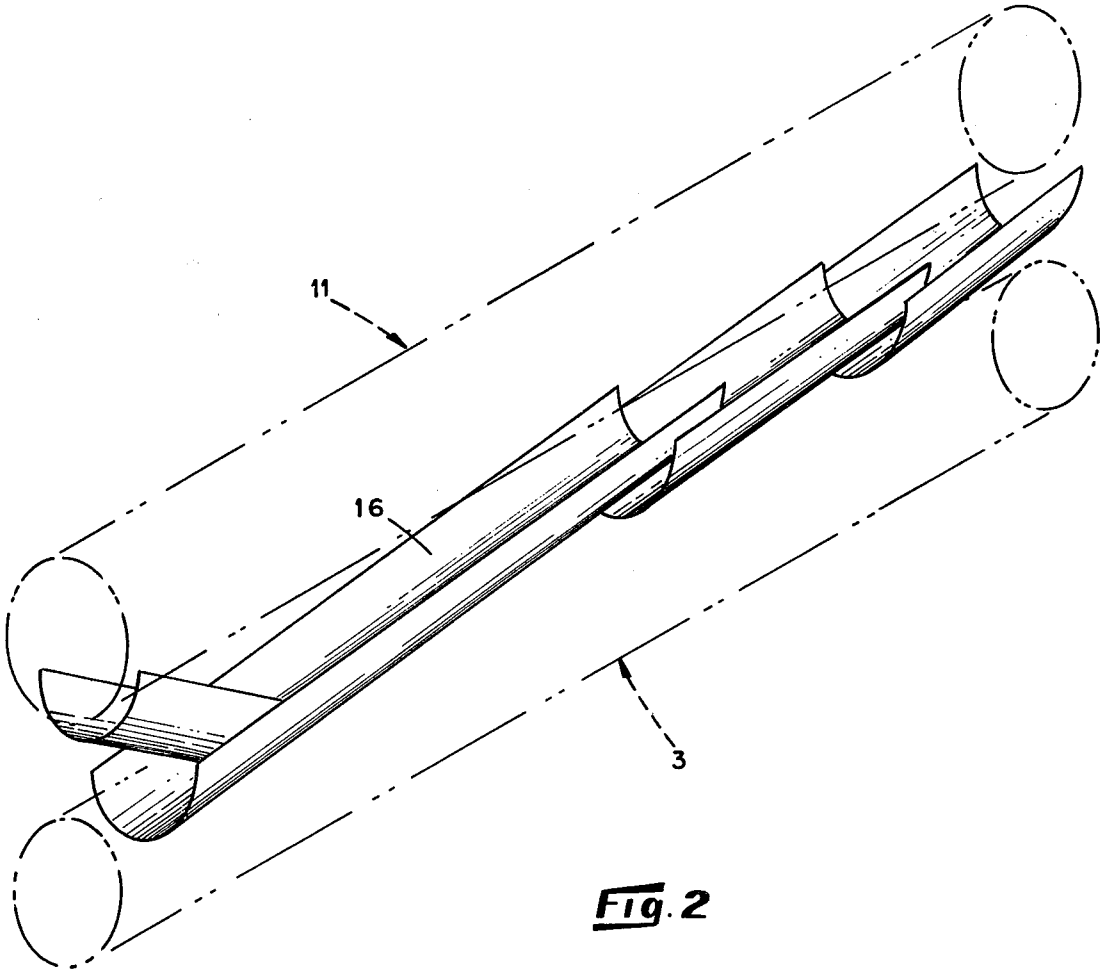
FIG. 2 is a schematic diagram showing the structure of the fluid conducting baffles.
Figure 3:
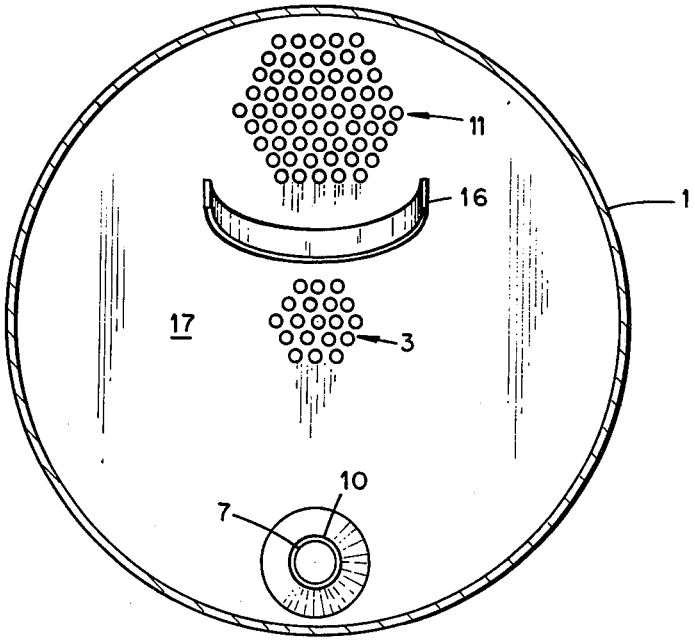
FIG. 3 is a cross-section taken across the line a-a, showing the relationship of the baffles and tube bundles within the shell.
Figure 4:
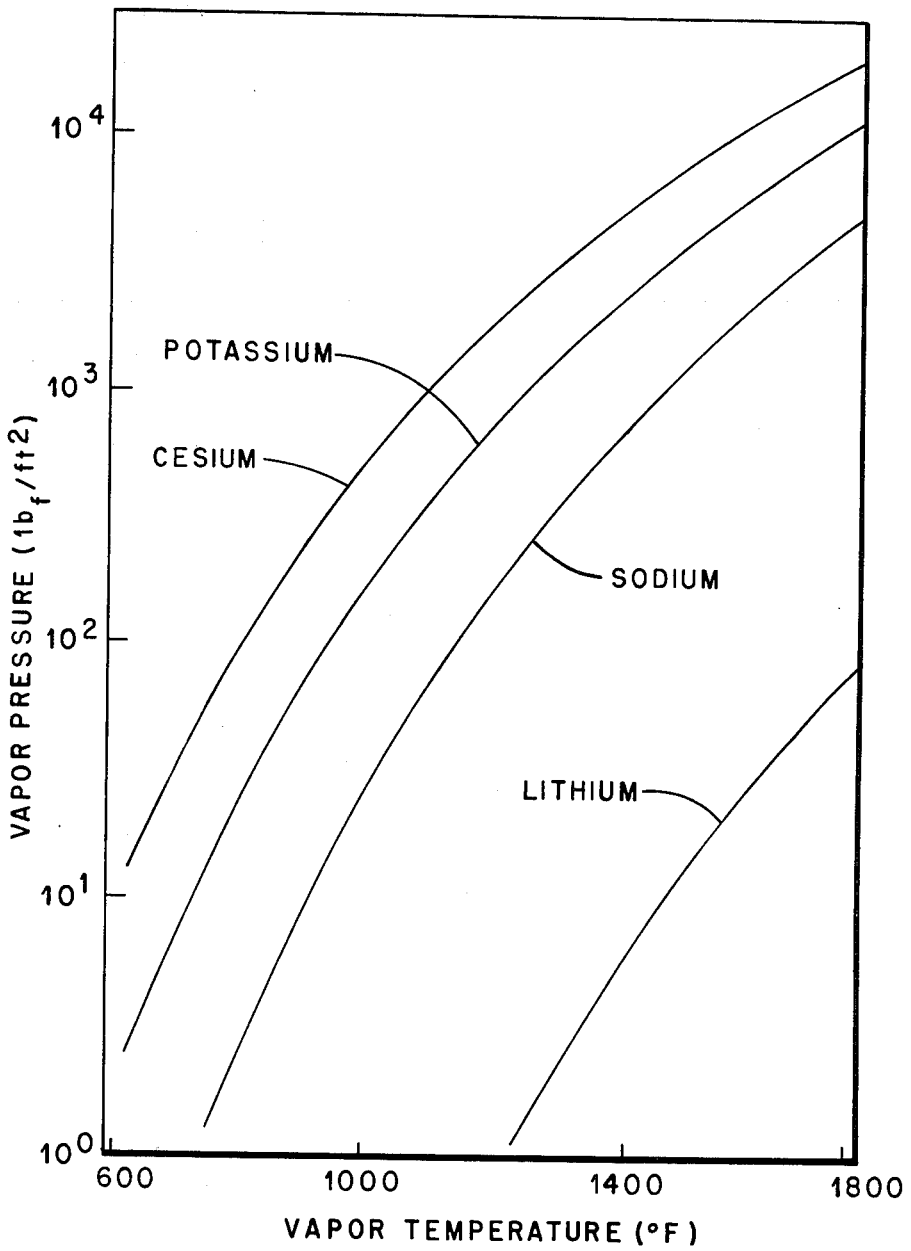
FIG. 4 is a graph showing the relation of vapor pressure to temperature for four candidate intermediate fluids.

Referring to FIG. 1, a liquid sodium-operated steam generator having cesium as an intermediate fluid comprises a housing or shell 1 having an interior cavity 2. The first tube bundle 3 is disposed within the interior cavity and conducts liquid sodium as the high temperature primary fluid. The tubes 4 in the first tube bundle can be any type which allows flow of primary fluid into and out of the heat exchanger, such as U-tubes or re-entrant bayonet tubes. During operation, liquid sodium enters through sodium inlet pipe 5 is concentric port 6 and flows through J-tubes 4 to an outlet header located about 25% of the way back from the return bend to provide flexibility. Primary fluid then flows back downward through the common return pipe 7 and exits through sodium exit pipe 9. A concentric sheath 10 provides a stagnant vapor annulus vented at the upper end. This annulus contains low pressure intermediate fluid and thermally insulates the cool return pipe from the hot vapor in the regions near the lower end. The second tube bundle 11 is disposed within the interior cavity generally parallel to the first tube bundle. The vertical direction is indicated by the arrow. Liquid feed water enters water inlet 12 and flows through the central region of concentric re-entrant bayonet tubes 13 where it boils and back through the annular region where it is superheated. In one embodiment (not shown) the central region of the bayonet tube near the water inlet is provided with a layer of insulation, e.g., ceramic, to minimize cooling of exiting superheated steam in the annular region by inlet water in the central region. This insulation layer should extend, for example, about one fourth of the length of the tube. The superheated steam then exits into steam plenum 14 to the steam outlet 15. The interior cavity 2 contains otherwise unconfined (except for transverse baffles 17) cesium and is properly termed the intermediate fluid region. During operation, cesium in the liquid state boils at the surface of the primary tubes and condenses at the surface of the secondary tubes. The higher temperature at the lower end of the primary fluid tube bundle will prevent the excessive accumulation of liquid cesium in that region. As is customary in the art, thermal sleeves 20 would be provided between the tube bundle header regions and the shell to avoid excessive temperature gradients and thermal stresses in the region of the structural junctures. The J-tubes 4 should preferably be sufficiently flexible to accommodate differential expansion between the tubes and the lower temperature common return pipe 7. For the required design conditions, additional flexibility could be obtained, for example, by including some bends along the length of the tubes. Disposed within the interior cavity in the region between the first and second tube bundles is a plurality of liquid conducting baffles 16. These baffles extend in the direction parallel to the first and second tube bundles, and overlap in a manner such that, should a leak develop in the steam circuit, the primary fluid bundle is protected from direct impingement of steam. As shown, the baffles are inclined to provide a gravity flow pathway for conducting liquid cesium (which condenses on the second tube bundle) to the first tube bundle. These baffles can be concave upward as shown in FIG. 2 or any other configuration capable of collecting condensed cesium and conducting it to the primary fluid tubes. These fluidconducting baffles are spaced apart from the periphery of the interior cavity to provide a pathway between the tube bundles for cesium vapor generated at the primary fluid tubes. The fluid-conducting baffles drain onto wicks 18 which can be, for example, stainless steel mesh and which surround primary fluid tubes 4 for distributing the condensate over the surfaces of the hot tubes. In one embodiment, the tubes 4 can have convoluted or spiral surfaces 8 as shown. It is preferred that the width between convolutions be ⅛ in. or less to provide capillary action which will help distribute the liquid over the tube surfaces.

A plurality of transverse baffles 17 extend in a direction perpendicular to the tube bundles thereby dividing the interior cavity into segments or regions. These transverse baffles have openings therein to accommodate the tube bundles 3 and 11 and the fluid conducting baffles 16. It is not necessary that a close fit be provided for structures passing through the transverse baffles or between the transverse baffles and the periphery of the interior cavity as shown, so long as the axial flow passage area for cesium vapor flow between the segments is no more than a few percent of the vapor flow passage area between the primary and secondary tube bundle regions.

During operation of the heat exchanger, the cesium pressure within the interior cavity will be low, on the order of 1 psia. This is desirable because it serves to minimize the effects of possible steam leaks. In the event of a steam leak in the second tube bundle, low pressure cesium vapor would react with the steam evolving hydrogen and this will increase the pressure in the low pressure intermediate fluid region. A hydrogen detector 19 is mounted within the upper region of the cavity for detecting the presence of a steam leak. The hydrogen detector may be of the type commercially available such as described in U.S. Pat. No. 3,651,789. Electronic control circuitry is responsive to the hydrogen detector and provides a control signal for controlling valve 21 in the water inlet pipe 22 to shut off the flow of water to the heat exchanger of the first sign of a leak. Inasmuch as the cesium in the interior cavity is at a low initial pressure and the intermediate vapor region volume is large, there will be sufficient time to stop the feed water flow prior to a destructive pressure build-up. In addition, the control circuitry can control a dump valve 23 mounted at the lower region of the cavity. The dump valve communicates to an evacuated reservoir at a lower temperature, e.g., room temperature. When hydrogen is detected, the dump valve is opened and liquid cesium quickly flows through the valve to the cooler reservoir before extensive pressure build-up in the shell occurs. It is preferred that some small clearance (e.g., ⅛ in. for a 4 ft. diameter shell) be left between the transverse baffles and the tube bundles and/or periphery of the shell to allow vapor to pass between regions in the event of a steam leak. Also, if desired, each segment may be provided with a hydrogen detection system. The dump valve can also be operated to exhaust the cesium prior to disassembly of the heat exchanger. To disassemble the heat exchanger, the water flow is cut off and the temperature of the interior cavity of the shell is maintained to rise above 500° F. The dump valve is then opened, the bulk of the liquid cesium is drained and residual droplets are distilled off to leave the interior of the shell bone-dry. The tube bundles are separately removable from the shell, facilitating disassembly, cleaning, or other maintenance.

Sample operating conditions for the heat exchanger are sodium entrance at 1100° F and exit at 900° F. The temperature of the primary fluid tubes would be 1050°-850° F. Water would enter at 600° F and steam exits at 950° F. The cesium vapor pressure within the shell will run between 0.5 psia in the coolest segment to about 2.1 psia in the hottest region, near the primary fluid inlet. The amount of intermediate fluid needed in the heat exchanger is a function of the design and operating conditions, and can be calculated or determined by routine experimentation. All that is necessary to operate the heat exchanger is to regulate the flow of feed water. The cesium will vaporize at the surfaces of the sodium tubes and condense at the surface of the steam generator tubes.

It will be apparent to those skilled in the art that substantial modifications can be made of the preferred embodiment without departing from the spirit and scope of this invention. For example, if U-tubes were used for the primary fluid circuit, additional axial baffles between the legs of the U would divide the vapor region into sub-regions so that the primary fluid in the exit leg would be associated with lower vapor temperature. Another possible configuration of the primary fluid tube would be an annulus of tubes emptying into a header communicating with a central return pipe. The tubes in the annulus would have bends or waves to accommodate thermal expansion.

What is claimed is:

1. A heat exchanger comprising:

a. a shell defining an interior cavity;

b. a first tube bundle disposed within said interior cavity for carrying high temperature primary fluid;

c. A second tube bundle disposed within said interior cavity generally parallel to and at a higher elevation than said first tube bundle, for carrying low temperature secondary fluid;

d. an intermediate fluid having a boiling point between the temperature of tubes in said first tube bundle and tubes in said second tube bundle disposed within said interior cavity such that during operation of said heat exchanger said intermediate fluid vaporizes at the surfaces of tubes in said first tube bundle and condenses at surfaces of tubes in said second tube bundle;

e. a liquid-conducting baffle disposed within said interior cavity in a region between said first and second tube bundles and extending in a direction parallel to said bundles for preventing the direct impingement of secondary fluid onto said first tube bundle in the event of a leak in said second tube bundle, said baffle being adapted for conducting condensed intermediate fluid from said second bundle to said first bundle; and f. a transverse baffle disposed within said housing and extending in a direction perpendicular to said tube bundles substantially to the periphery of said interior cavity for dividing said heat exchanger into regions of different temperature.

2. The heat exchanger of claim 1 in which the primary fluid is sodium, the secondary fluid is water, and the intermediate fluid is selected from the group of sodium, lithium, potassium, rubidium, and cesium and mixtures thereof.

3. The heat exchanger of claim 2 in which said intermediate fluid is cesium.

4. The heat exchanger of claim 2 further comprising a dump valve communicating with said interior cavity and with a reservoir of lower temperature than said interior cavity, for removing intermediate fluid from said interior cavity.

5. A heat exchanger comprising:

a. a shell defining an interior cavity;

b. a first tube bundle disposed within said interior cavity for carrying high temperature primary fluid said primary fluid being sodium;

c. a second tube bundle disposed within said interior cavity generally parallel to and at a higher elevation than said first tube bundle, for carrying low temperature secondary fluid said secondary fluid being water;

d. an intermediate fluid selected from the group of sodium, lithium, potassium, rubidium, and cesium and mixtures thereof, said intermediate fluid having a boiling point between the temperature of tubes in said first tube bundle and tubes in said second tube bundle disposed within said interior cavity such that during operation of said heat exchanger said intermediate fluid vaporizes at the surfaces of tubes in said first tube bundle and condenses at surfaces of tubes in said second tube bundle;

e. a liquid-conducting baffle disposed within said interior cavity in a region between said first and second tube bundles and extending in a direction parallel to said bundles for preventing the direct impingement of secondary fluid onto said first tube bundle in the event of a leak in said second tube bundle, said baffle being adapted for conducting condensed intermediate fluid from said second bundle to said first bundle; and f. means disposed within said interior cavity for detecting hydrogen.

6. The heat exchanger of claim 5 further comprising electronic control circuitry responsive to said hydrogen detection means for controlling a valve for regulating the flow of water to said second tube bundle, whereby said valve is activated to halt the flow of water to said second tube bundle in the event of a leak in said second tube bundle.

7. The heat exchanger of claim 5 further comprising electronic control circuitry responsive to said hydrogen detection means for controlling a dump valve communicating with said interior cavity and with a reservoir at a lower temperature than said interior cavity, whereby said dump valve is activated to permit the flow of intermediate fluid from said interior cavity in the event of a leak in said second tube bundle.

8. The heat exchanger of claim 7 wherein said electronic control circuitry also controls a valve for regulating the flow of water to said second tube bundle, whereby said water flow valve is activated to halt the flow of water to said second tube bundle in the event of a leak in said second tube bundle.

9. The heat exchanger of claim 5 in which said intermediate fluid is cesium.

10. The heat exchanger of claim 5 further comprising a dump value communicating with said interior cavity and with a reservoir of lower temperature than said interior cavity for removing intermediate fluid from said interior cavity.

* * * * *